United States Patent [19]

Ferraro

[11] 4,180,768

[45] Dec. 25, 1979

[54] ENERGY LIMITING FOLDBACK CIRCUIT FOR POWER SUPPLY

[75] Inventor: Angelo Ferraro, Ballston Lake, N.Y.

[73] Assignee: Tele/Resources, Incorporated, Armonk, N.Y.

[21] Appl. No.: 926,504

[22] Filed: Jul. 20, 1978

[51] Int. Cl.[2] ..... G05F 1/58

[52] U.S. Cl. ..... 323/9; 323/20; 361/79

[58] Field of Search ..... 323/9, 20; 307/237, 307/264, 300; 324/158 T; 361/18, 79, 83

[56] References Cited

U.S. PATENT DOCUMENTS

| | | | |
|---|---|---|---|
| 3,201,680 | 8/1965 | Ross et al. | 323/9 |
| 3,240,997 | 3/1966 | Burgi et al. | 323/9 X |
| 3,345,554 | 10/1967 | Lupoli | 323/9 X |
| 3,500,172 | 3/1970 | Eckstein | 323/9 |
| 3,534,249 | 10/1970 | Neill et al. | 323/9 X |
| 3,564,338 | 2/1971 | Teshirogi et al. | 361/79 |
| 3,723,774 | 3/1973 | Rogers | 323/9 X |
| 3,784,877 | 1/1974 | Cowell | 361/79 |
| 3,796,943 | 3/1974 | Nelson et al. | 323/9 |

*Primary Examiner*—A. D. Pellinen
*Attorney, Agent, or Firm*—Victor J. Toth

[57] ABSTRACT

An energy limiting foldback circuit for use with power supply having a power control device in its output. The energy limiting foldback circuit contains a voltage sensing device for sensing the potential drop between the input and the output of the power control device. The foldback circuit also includes a current sensing device for sensing the current through the power control device. A conduction control circuit is included which is responsive to the outputs of the voltage sensing device and the current sensing device. The conduction control circuit acts to contrcl the operating conduction through the power control device. The energy limiting circuit can also include a pulsing circuit operative in the event of output fault to periodically pulse the power control device into a momentary conduction state.

6 Claims, 6 Drawing Figures

ENERGY LIMITING FOLDBACK CIRCUIT FOR POWER SUPPLY

BACKGROUND OF THE INVENTION

1. Field of the Invention

This invention relates generally to power supplies and more particularly to circuits for controlling the output of power supplies within previously defined voltage and current limits so as to prevent damage to both the source of power being supplied and the devices to which the power is supplied.

2. Description of the Prior Art

Foldback circuits for use with current limited or voltage limited power supplies are known in the prior art and typically employ conventional operational amplifiers, integrated circuits, and the like to achieve a foldback of operating current to within one-third to two-thirds of the normal full operating load current of the power supply. This foldback condition in the prior art is typically achieved using a nearly linear analog scheme to achieve a foldback of current during an apparent short fault in the output of the supply. One problem of this analog type of scheme is that the holding of this nominal current level can maintain current conditions which might harm circuitry powered by the power supply. The nominal level of current achieved during foldback condition typically varies significantly and is not predictable thereby further resulting in potential damage to the output electronics.

It is therefore an object of the present invention to have a foldback circuit which folds back the current to a zero level condition on the occurrence of a sensed short fault in the output of the supply. It is a further object of the present invention to achieve this foldback condition in response to any unusually high current condition whether due to source power surges or current demand of circuitry supplied by the power supply.

A further object of the present invention is to achieve a dynamic monitoring of the condition of the load so as to return the supply to full operating condition at such time as a short fault is eliminated. Yet another object of the present ivention is to provide a power supply having a foldback circuit of high reliability and low noise which is not susceptible to failure in such a way as to harm equipment powered by the supply.

SUMMARY OF THE INVENTION

An energy limiting foldback circuit according to the present invention is employed in connection with a power supply having a power control device in the output of that power supply. Representative power control devices include transistors, vacuum tubes, thyristors, or any other device which includes a means for controlling the conduction of energy there through. The energy limiting foldback circuit of the present invention comprises a voltage sensing means for sensing the potential drop between the input and the output of the power control device. The energy limiting foldback circuit of the present invention also comprises a current sensing means for sensing the current through the power control device. The energy limiting foldback circuit according to the present invention also comprises a conduction control means responsive to the output of the voltage sensing means and the current sensing means for controlling the operating conduction through the power control device.

An energy limiting foldback circuit according to the present invention can include, as a portion of the conduction control means, a latching means for latching the conduction through the power control device in an "off" condition. The energy limiting foldback circuit of the present invention can also include means for sensing the thermal operating condition of the power supply.

A further embodiment of the energy limiting foldback circuit of the present invention further comprises pulse means for periodically pulsing the power control device into a momentary conduction condition. Preferably, the momentary conduction condition is constrained only by the upper current limit of the current sensing means. The pulse means is preferably operative in response to a preset minimum potential appearing between the input and output of the power control device so as to limit the presence of noise on the power supply. These and other features of the present invention will become apparent to one of ordinary skill in the art upon further consideration of the following description of preferred embodiments of the invention when taken together with the accompanying figures.

DESCRIPTION OF PREFERRED EMBODIMENT

Figure 1:
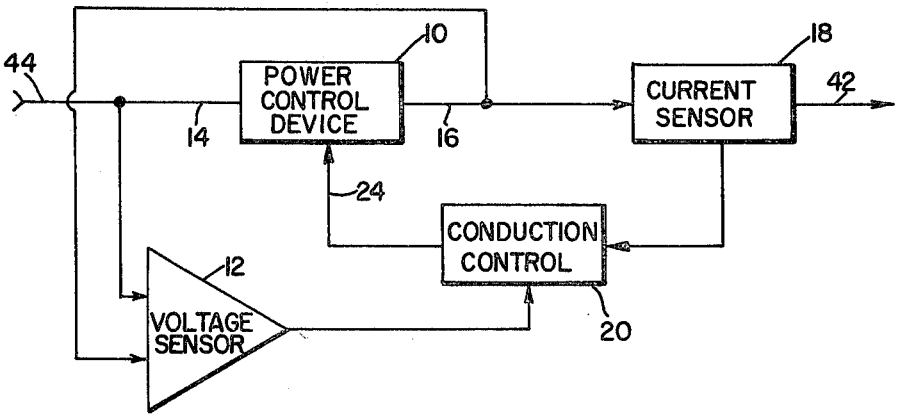
FIG. 1 is a block diagram of an energy limiting foldback circuit according to the present invention.

In FIG. 1 there is illustrated an energy limiting foldback circuit according to the present invention. The energy limiting foldback circuit operates on a power control device 10 which is conventionally found in the output stages of a power supply. The foldback circuit comprises a voltage sensing means 12 for sensing the potential drop between the input 14 and the output 16 of the power control device 10. The energy limiting foldback circuit further comprises a current sensing means 18 for sensing the current through the power control device 10. The foldback circuit further comprises a conduction control means 20 which is responsive to the output of the voltage sensing means 12 and the current sensing means 18 for controlling the operating conduction through the power control device 10. In the further description of preferred embodiments, similar reference numerals will be used wherever possible indicating means having similar functions but without limitation as to the employment of particular devices.

Figure 3:
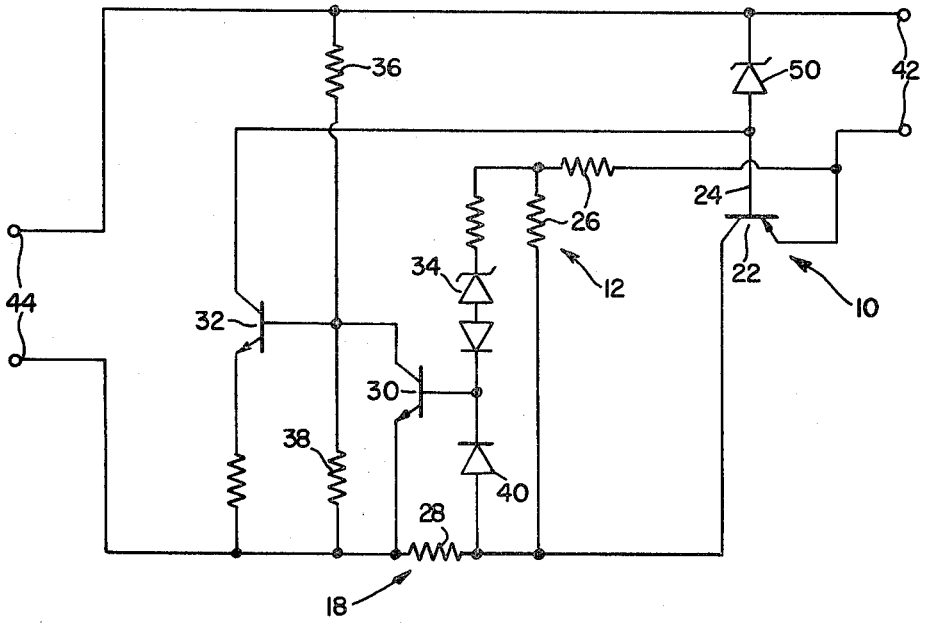
FIG. 3 is a schematic diagram of a first preferred embodiment of the invention.

FIG. 3 is illustrative of a circuit embodying a foldback circuit for the output of a power supply in accordance with the present invention as illustrated in FIG. 1. A power control device 10, namely a power transistor 22, is included in the output from a power supply to control output current. The output current is controlled by the current present on the control terminal 24 which is the base of the power transistor 22. A voltage sensor means, namely a voltage divider 26, senses the potential difference between the input and the output of the power control device. The potential difference is sensed between the collector and emitter of the power transistor 22. A current sensor 18, namely resistor 28, senses the current passing through the power transistor 22. The potential sensed by the voltage divider 26 and the current sensed by resistor 28 act in conjunction on transistors 30 and 32 as herein explained to produce a signal to the base 24 of the power transistor 22 to control the current passing therethrough. In the event the potential measured by voltage divider 26 increases beyond a preselected point established by zener diode 34, a current flows causing transistor 30 to saturate. This saturation condition lowers the bias potential on the base of transistor 32 established by resistors 36 and 38 to such a point that the collector emitter current in transistor 22 is reduced to zero thereby cutting off conduction in transistor 22.

In somewhat similar manner, an increased potential difference across resistor 28 due to an increased current therethrough causes a small current to develop through diode 40 and the emitter of transistor 30. This conduction is transistor 30 again lowers the bias point of the base of transistor 32 so as to reduce the collector-emitter current through transistor 32, which in turn reduces the current through power transistor 22. This reduction in current through transistor 22 is mirrored by a similar reduction in current through resistor 28 thereby affecting a current limiting operation on the power supply to the output 42.

While the current limiting operation of the circuit illustrated in FIG. 3 is, in effect, self correcting, it is to be noted that the voltage limitation provided by voltage divider 26 and zener diode 34 tends to be a latching system. That is, in the event of a short appearing at output 42, the total potential difference across input 44 appears between the emitter and collector of transistor 22. A near short condition existing at output 42 would similarly result in a proportionately large potential existing between the emitter and collector of transistor 22 and hence across potential divider 26. At a preset potential established by zener diode 34, transistor 22, too, is placed into a zero conduction state as previously described. With no current going through transistor 22, there is no way to relieve the high potential condition originally caused by the short condition originally present across output 42 so long as the load now appearing at output 42 is essentially capacative. The presence of an inductive or resistive load will result in a resetting of the circuit to original conditions.

Thus, as illustrated in FIG. 1, the conduction control 20, effected in FIG. 3 by transistors 30 and 32 applies a signal to the control terminal 24 of the power control device which in FIG. 3 is the base of power transistor 22.

Figure 2:
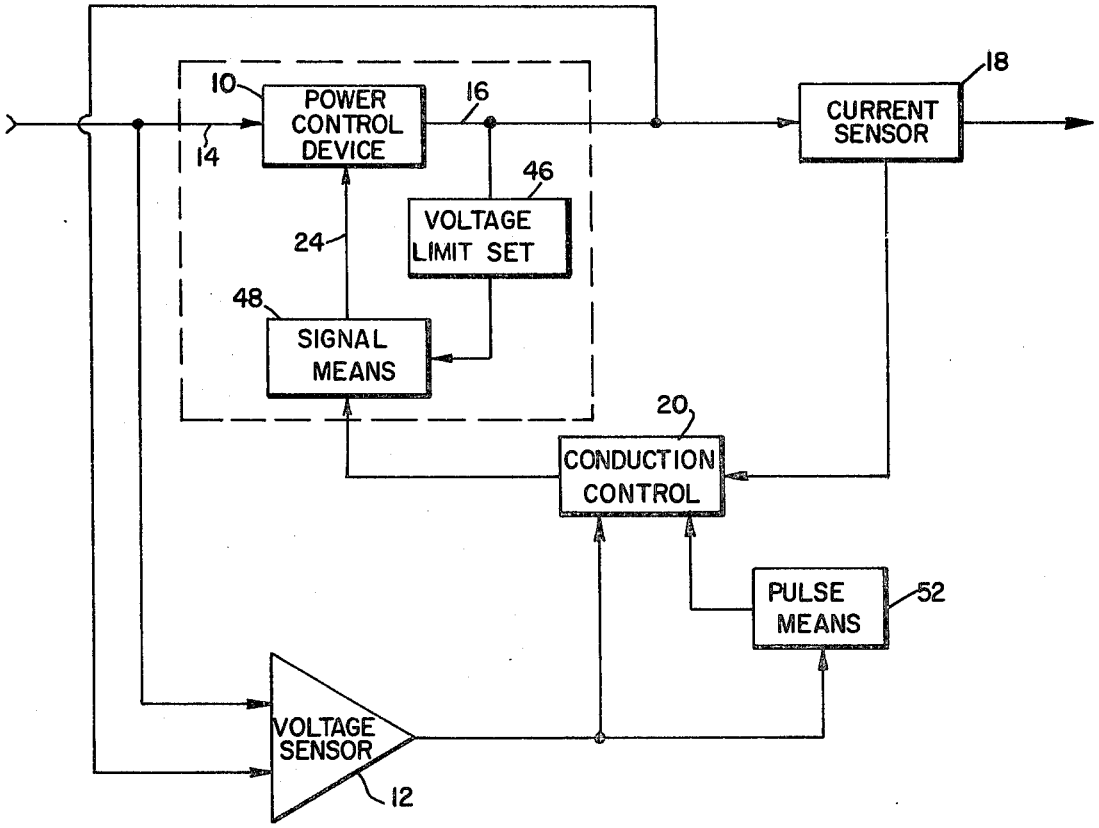
FIG. 2 is a block diagram of the energy limiting foldback circuit illustrated in FIG. 1 further showing its functional relation with a constant voltage power supply and further illustrating a pulse circuit for dynamically interrogating the circuit conditions.
Figure 4:
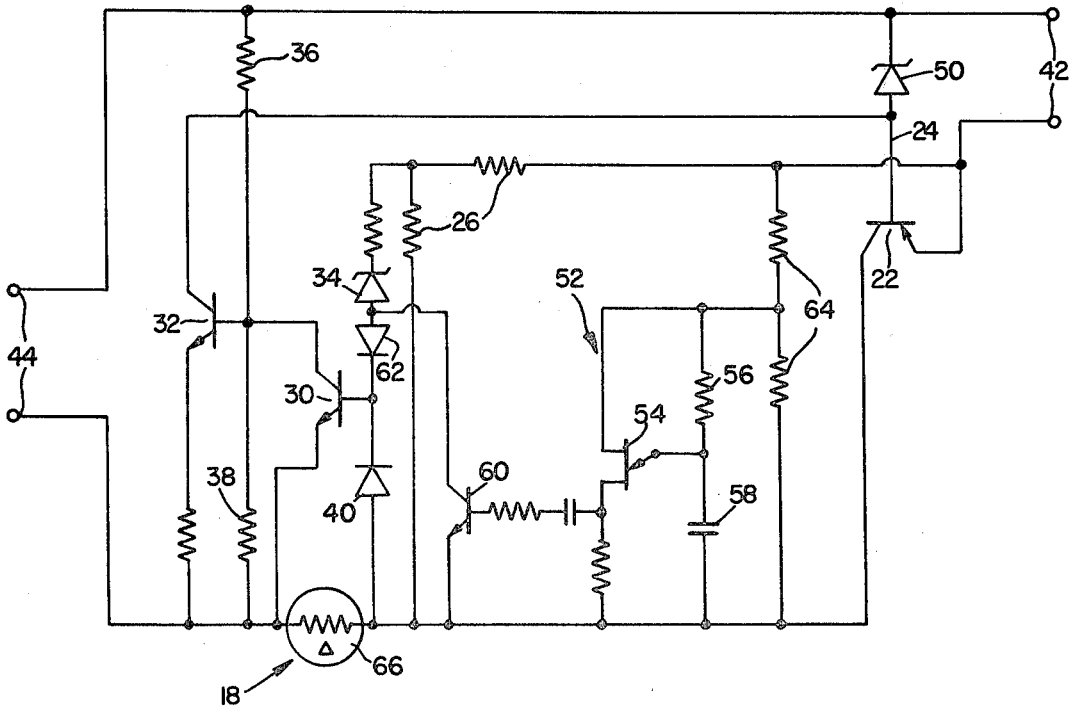
FIG. 4 is a schematic diagram of a second preferred embodiment of the invention including a pulse circuit.

FIG. 2 further illustrates in block form the energy limiting foldback circuit according to the present invention. The power control device 10 has connected to its output 16 a voltage limit means 46 for specifying the maximum output voltage of the supply. A signal means 48 is provided which is responsive to the voltage limit means for generating a signal to be applied to the control terminal 24 of the power control device 10. The voltage limit means is illustrated in FIGS. 3 and 4 as zener diode 50 while signal means 48 comprises transistor 32 and associated circuitry. The conduction control means 20 is illustrated to operate directly on signal means 48 which in turn operates on the input terminal 24 of power control device 10. The voltage sensor 12 and current sensor 18 sense the potential difference across and current through the power control device as previously described.

A pulse means 52 is also included in the circuit illustrated in FIG. 2. The pulse means acts to periodically pulse the power control device into a momentary conduction state. The operation of this pulse control means is illustrated in the circuit shown in FIG. 4. An oscillator comprising the unijunction transistor 54 and associated circuitry having a period established by the R-C time constant provided by resistor 56 and capacitor 58 periodically provides a signal which is placed in a square pulse form by following transistor 60. The square pulse is periodically introduced between zener diode 34 and diode 62 thereby providing an essentially zero resistant path for any current passing through zener diode 34. Current occurs through zener diode 34 only in the event of a potential difference existing across potential divider 26 above a preselected level which, it is recalled, exists only when an apparent short condition exists between output 42. During this condition, the current flowing through zener diode 34 continues through the emitter of transistor 30 thereby causing the transistor to saturate. But, during each pulse generated by pulse means 52, an alternative path through following transistor 60 exists thereby permitting transistor 30 to cut out of saturation. This is in turn reestablishes the bias point of transistor 32 at its normal operating condition which in turn permits conduction through power transistor 22. If the apparent short fault occurring at output 42 has been corrected, the circuit will return to normal operation. If, on the other hand, the short fault still appears, the high potential difference will continue to be sensed by the voltage divider 26 and current will only be permitted to flow through power transistor 22 during each of the pulses generated by pulse means 52.

This periodic pulsing by pulse means 52 continues so long as any substantial potential difference exists between the emitter and collector of power transistor 22. In the circuit shown in FIG. 4, as the potential difference between emitter and collector of power transistor 22 diminishes, the necessary potential to cause oscillation of unijunction transistor 54 also diminishes, the oscillations ceasing at an appropriate preselected level depending on potential divider 64. It will be appreciated that if the potential divider 64 were appropriately positioned, the oscillation of unijunction transistor 54 could be continuous if so desired. The discontinuous oscillation scheme presented by FIG. 4 is believed preferable inasmuch as this provides for a reduced noise level on the output of the power supply. As shown in FIG. 4, the current sensor 18 comprises a thermistor 66 for sensing the thermal condition of the power supply. In this manner, a current limitation can be imposed on the output of the power supply depending on appropriately measured thermal conditions.

Figure 5:
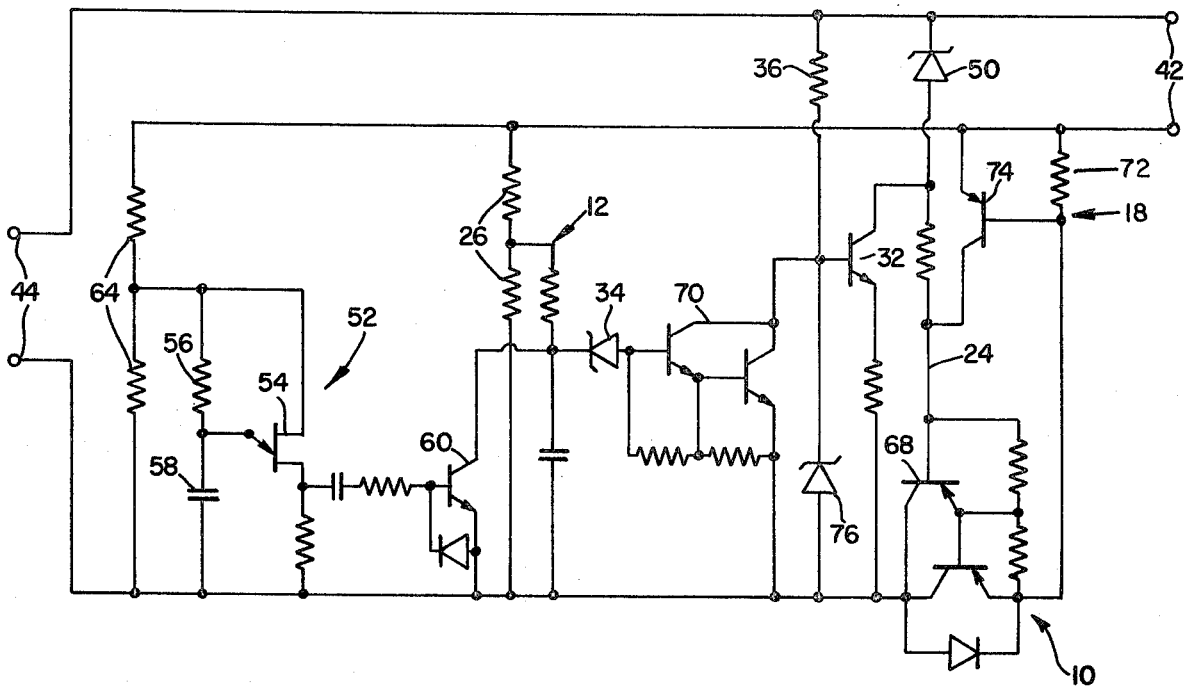
FIG. 5 is a schematic diagram of yet a third preferred embodiment of the invention.

In FIG. 5 there is illustrated yet another embodiment of the invention. In the embodiment illustrated in FIG. 5, the power control means 10 comprises a Darlington transistor series 68 having control terminal 24 analogous to the base of power transistor 22 illustrated in FIGS. 3 and 4. A voltage sensing means 12 is included in the foldback circuit similar to that illustrated in FIGS. 3 and 4. The sensed potential by the voltage sensing means 12, if sufficient to overcome the zener diode break-down potential of zener diode 34, permits a current to be applied to the base of the first of the Darlington series 70. In a fashion similar to the operation of transistor 30 in FIGS. 3 and 4, Darlington series 70 reduces the bias potential of transistor 32 thereby preventing the base current required at control terminal 24 of Darlington series 68. This in turn causes a termination of conduction through the Darlington series 68 in response to a sensed short condition at output 42.

The foldback circuit illustrated in FIG. 5 also includes a current sensng means 18 which comprises resistor 72 and transistor 74. As the current through resistor 72 increases, the increased facing their potential permits conduction through transistor 74 thereby reducing the potential on control terminal 24 which in turn reduces the current permitted through power control device 10. This in turn reduces the current through resistor 72 thus establishing a self limiting current loop. The bias potential of transistor 32 which provides the signal to control terminal 24 is established by resistor 36 and zener diode 76 in a manner similar to that presented by resistors 36 and 38 shown in FIGS. 3 and 4.

Figure 6:
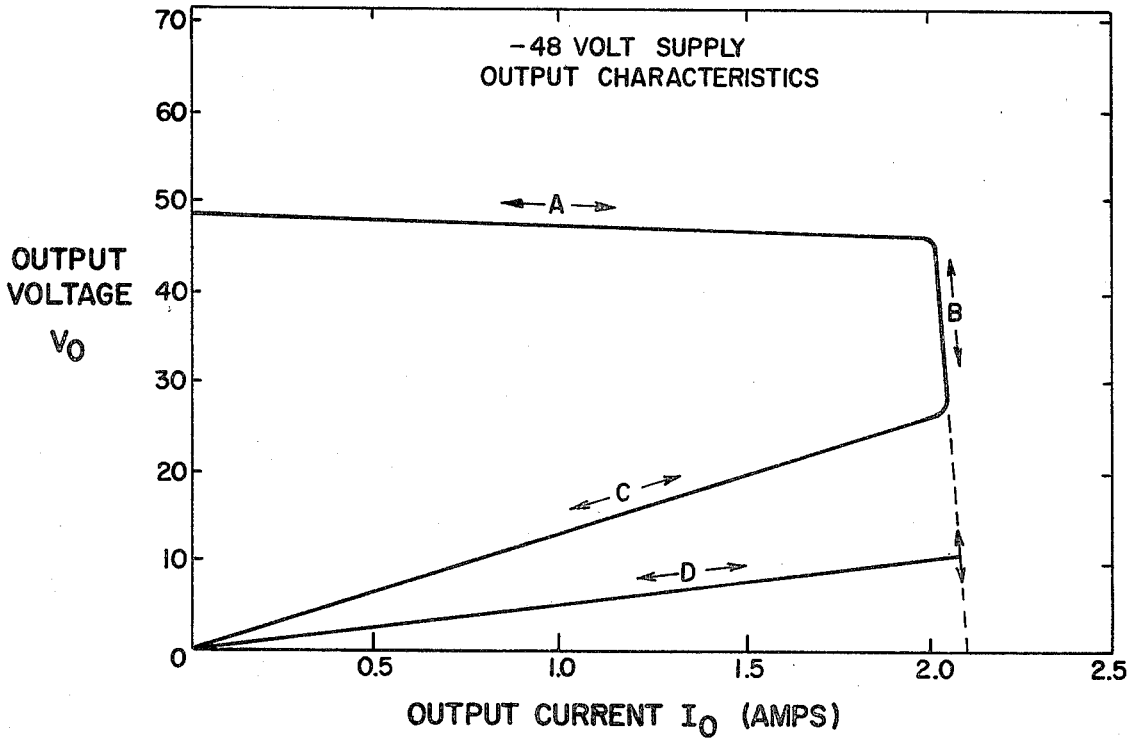
FIG. 6 is a graph of the output characteristics of a power supply constructed in accordance with the third preferred embodiment of the invention illustrated in FIG. 5.

The performance of the circuit illustrated in FIG. 5 is shown graphically in FIG. 6. The output characteristics, output voltage and output current, have been measured across output 42 of a power supply including an energy limiting foldback circuit as illustrated in FIG. 5. Over a first portion of the operating curve of this circuit A, the power supply operates as essentially constant voltage supply independent of current demand. Over a second portion of the operating curve of the supply B, the supply acts as an essentially constant current supply with dramatically decreasing output voltage with increasing load on the output of the supply. The operating portion B of the illustrated curve is controlled principally by the current sensing means 18 and associated circuitry. This portion of the curve has particular advantages when the present circuit is used as a power supply for conventional PBX station sytems wherein continuous operation of all possible circuits is desired. The maintenance of maximum current level with increasing load for a period of time often relieves a temporary fault condition thereby permitting the power supply to return to normal operation on segment A of the operating curve. In the event of dramatic and sustained short fault conditioning existing on the output of the power supply, it is desirable that the foldback portion of the curve C become operative. Operation on portion C of the operating curve is initiated by the presence of a current through zener diode 34 which, as previously described, results in a signal being applied to control terminal 24 of the power control device 10 in such a fashion as to reduce the current through the device to zero.

Thereafter, the pulsing means 52 periodically presents a pulse through the Darlington series 70 to control terminal 24 to permit a small burst of current through the control device 10. This burst of current can be viewed as a momentary burst along line D illustrated in FIG. 6. The slope of line D is dependent upon the load condition appearing at output 42 of the circuit. As the load condition returns to normal, the slope of line D increases to such a point as to overlap line C, and the pulse then returns the power supply to normal operation on portions A and/or B of the operating curve.

While the present invention has been described with particular reference to specific embodiments illustrated in the several figures, it will be apparent to those skilled in the art that reasonable modification can be made which still remains within the spirit and scope of the present invention as defined by the appended claims.

What is claimed is:

1. An energy limiting foldback circuit for a power supply having a power control device in the output thereof, the energy limiting foldback circuit comprising:

(a) voltage sensing means for sensing the potential drop between the input and output of the power control device, (b) current sensing means for sensing the current through the power control device, (c) conduction control means responsive to predetermined combined range of output levels of the voltage sensing means and the current sensing means for controlling the operating conduction through the power control device whereby controlled conduction is permitted during a threshold range of said output levels and zero conduction is achieved when said output levels exceed said threshold range, and (d) timing control means associated with said voltage sensing means and said conduction control means for allowing an excessive voltage condition to exist across the power control device for a predetermined amount of time before said conduction control means becomes operative.

2. The energy limiting foldback circuit of claim 1 wherein the conduction control means comprises means for latching the conduction through the power control device in an off condition.

3. The energy limiting foldback circuit of claim 1 wherein the current sensing means further comprises temperature compensation means means for sensing the thermal operating condition of the power supply and changing said predetermined output levels to adjust for changes in said thermal operating condition.

4. The energy limiting foldback circuit of claim 1 further comprising pulse means for periodically pulsing the power control device into a momentary conduction condition to test for clearance of a fault condition.

5. The energy limiting foldback circuit of claim 4 wherein the pulse means operates in response to a preset minimum potential appearing between the input and output of the power control device.

6. The energy limiting foldback circuit of claim 4 wherein said momentary conduction condition is constrained only by the upper current limit of the current sensing means.

* * * * *